US009217974B2

(12) United States Patent
Shida

(10) Patent No.: US 9,217,974 B2
(45) Date of Patent: Dec. 22, 2015

(54) IMAGE FORMING APPARATUS

(71) Applicant: CANON KABUSHIKI KAISHA, Tokyo (JP)

(72) Inventor: Masanori Shida, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/506,126

(22) Filed: Oct. 3, 2014

(65) Prior Publication Data

US 2015/0023681 A1 Jan. 22, 2015

Related U.S. Application Data

(63) Continuation of application No. PCT/JP2013/060769, filed on Apr. 3, 2013.

(30) Foreign Application Priority Data

Apr. 3, 2012 (JP) ..... 2012-085033

(51) Int. Cl.
*G03G 15/16* (2006.01)
*G03G 15/00* (2006.01)
*G03G 15/01* (2006.01)

(52) U.S. Cl.
CPC ..... *G03G 15/5004* (2013.01); *G03G 15/0131* (2013.01); *G03G 15/1605* (2013.01); *G03G 15/1675* (2013.01)

(58) Field of Classification Search
CPC ..... G03G 15/1675; G03G 15/1605; G03G 15/0131; G03G 2215/0119
See application file for complete search history.

(56) References Cited

U.S. PATENT DOCUMENTS

| | | | | |
|---|---|---|---|---|
| 6,294,305 | B1 | 9/2001 | Kobayashi et al. | |
| 6,618,565 | B2 | 9/2003 | Tamiya et al. | |
| 7,620,354 | B2 | 11/2009 | Shimura et al. | |
| 8,874,013 | B2 * | 10/2014 | Aoki | 399/299 |
| 2005/0232663 | A1 | 10/2005 | Shimura et al. | |
| 2010/0209128 | A1 * | 8/2010 | Sueoka | 399/66 |
| 2013/0188980 | A1 | 7/2013 | Ito et al. | |
| 2013/0188981 | A1 | 7/2013 | Horiguchi et al. | |
| 2013/0287417 | A1 * | 10/2013 | Saito | 399/49 |
| 2015/0003880 | A1 * | 1/2015 | Ohno et al. | 399/302 |

(Continued)

FOREIGN PATENT DOCUMENTS

| | | | |
|---|---|---|---|
| JP | 2003-35986 | A | 2/2003 |
| JP | 2003-295634 | A | 10/2003 |

(Continued)

OTHER PUBLICATIONS

U.S. Appl. No. 14/505,724, filed Oct. 3, 2014, Tohru Nakaegawa.

(Continued)

*Primary Examiner* — William Perkey
(74) *Attorney, Agent, or Firm* — Fitzpatrick, Cella, Harper & Scinto

(57) ABSTRACT

A controller controls a voltage to be applied to the transfer member when there is a recording material having a predetermined largest width at a secondary-transfer position, so that a constant-voltage element maintains a predetermined voltage, whereby it is possible to prevent transfer defect due to short of a primary-transfer electric field at a primary-transfer portion when a toner image is secondary-transferred onto the recording material.

14 Claims, 7 Drawing Sheets

(56) References Cited

U.S. PATENT DOCUMENTS

| | | | | |
|---|---|---|---|---|
| 2015/0016833 | A1* | 1/2015 | Nakaegawa et al. | 399/66 |
| 2015/0023680 | A1* | 1/2015 | Nakaegawa et al. | 399/66 |
| 2015/0023681 | A1* | 1/2015 | Shida | 399/66 |
| 2015/0093133 | A1* | 4/2015 | Nakaegawa et al. | 399/66 |

FOREIGN PATENT DOCUMENTS

| | | | |
|---|---|---|---|
| JP | 2005-250254 | A | 9/2005 |
| JP | 2006-259640 | A | 9/2006 |
| JP | 2012-98709 | A | 5/2012 |

OTHER PUBLICATIONS

U.S. Appl. No. 14/505,615, filed Oct. 3, 2014, Tohru Nakaegawa.

U.S. Appl. No. 14/505,736, filed Oct. 3, 2014, Tohru Nakaegawa.

U.S. Appl. No. 14/506,033, filed Oct. 3, 2014, Tohru Nakaegawa.

International Search Report dated Jun. 11, 2013, in International Application No. PCT/JP2013/060769.

International Preliminary Report on Patentability dated Oct. 7, 2014, in International Application No. PCT/JP2013/060769.

* cited by examiner

IMAGE FORMING APPARATUS

TECHNICAL FIELD

The present invention relates to an image forming apparatus using an electrophotographic type, such as a copying machine, a printer or the like.

BACKGROUND ART

In an electrophotographic type image forming apparatus, in order to meet various recording materials, an intermediary transfer type is known, in which a toner image is transferred from a photosensitive member onto an intermediary transfer member (primary-transfer) and then is transferred from the intermediary transfer member onto the recording material (secondary-transfer) to form an image.

Japanese Laid-open Patent Application 2003-35986 discloses a conventional constitution of the intermediary transfer type. More particularly, in Japanese Laid-open Patent Application 2003-35986, in order to primary-transfer the toner image from the photosensitive member onto the intermediary transfer member, a primary-transfer roller is provided, and a power source exclusively for the primary-transfer is connected to the primary-transfer roller. Furthermore, in Japanese Laid-open Patent Application 2003-35986, in order to secondary-transfer the toner image from the intermediary transfer member onto the recording material, a secondary-transfer roller is provided, and a voltage source exclusively for the secondary-transfer is connected to the secondary-transfer roller.

In Japanese Laid-open Patent Application 2006-259640, there is a constitution in which a voltage source is connected to an inner secondary-transfer roller, and another voltage source is connected to the outer secondary-transfer roller. In Japanese Laid-open Patent Application 2006-259640, there is description to the effect that the primary-transfer of the toner image from the photosensitive member onto the intermediary transfer member is effected by voltage application to the inner secondary-transfer roller by the voltage source.

SUMMARY OF THE INVENTION

Problem to be Solved by Invention

However, when the voltage source exclusively for the primary-transfer is provided, there is a liability that it leads to an increase in cost, so that a method for omission of the voltage source exclusively for the primary-transfer is desired.

A constitution in which a voltage source exclusively for the primary-transfer is omitted, and the intermediary transfer member is grounded through a constant-voltage element to produce a predetermined primary-transfer voltage, has been found.

However, in the above constitution, with a wider width of the recording material, an amount of a current flowing from an outside of the recording material with respect to a widthwise direction toward the constant-voltage element side is decreased at a secondary-transfer portion. For that reason, the constant-voltage element cannot maintain a predetermined voltage, so that there is a possibility that the potential of the intermediary transfer member becomes low and thus primary-transfer defect due to short of a transfer contrast is generated.

Means for Solving Problem

The present invention provides an image forming apparatus comprising: an image bearing member for bearing a toner image; an intermediary transfer member for carrying the toner image primary-transferred from the image bearing member at a primary-transfer position; a transfer member, provided contactable to an outer peripheral surface of the intermediary transfer member, for secondary-transferring the toner image from the intermediary transfer member onto a recording material at a secondary-transfer position; a constant-voltage element, electrically connected between the intermediary transfer member and a ground potential, for maintaining a predetermined voltage by passing of a current therethrough; a power source for forming, by applying a voltage to the transfer member to pass the current through the constant-voltage element, both of a secondary-transfer electric field at the secondary-transfer position and a primary-transfer electric field at the primary-transfer position; and a controller for controlling a voltage, so that the constant-voltage element maintains the predetermined voltage, to be applied to the transfer member by the power source when the toner image is secondary-transferred onto the recording material having a predetermined largest width with respect to a widthwise direction perpendicular to a feeding direction.

Effect of the Invention

The controller controls a voltage to be applied to the transfer member when the recording material having the predetermined largest width exists at the secondary-transfer position, so that the constant-voltage element maintains the predetermined voltage, whereby it is possible to prevent transfer defect due to short of the primary-transfer electric field at the primary-transfer portion when a toner image is secondary-transferred onto the recording material.

EMBODIMENTS FOR CARRYING OUT INVENTION

Figure 1:
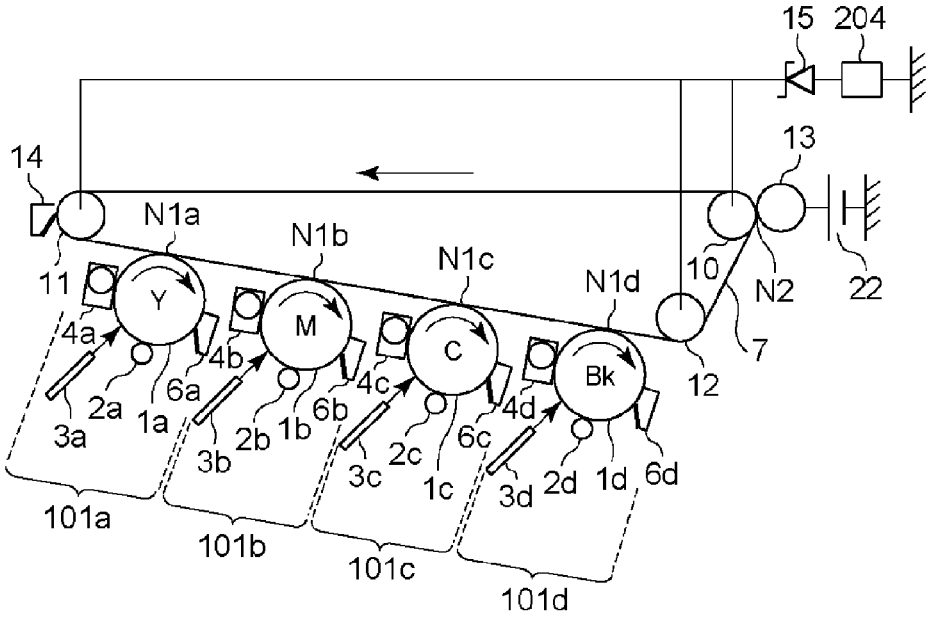
FIG. 1 is an illustration of a basic structure of an image forming apparatus.

In the following, embodiments of the present invention will be described along the drawings. Incidentally, in each of the drawings, the same reference numerals are assigned to elements having the same structures or functions, and the redundant description of these elements is omitted.

Embodiment 1

Image Forming Apparatus

FIG. 1 shows an image forming apparatus in this embodiment. The image forming apparatus employs a tandem type in which image forming units for respective colors are independent and arranged in tandem. In addition, the image forming apparatus employs an intermediary transfer type in which toner images are transferred from the image forming units for respective colors onto an intermediary transfer member, and then are transferred from the intermediary transfer member onto a recording material.

Image forming stations 101*a*, 101*b*, 101*c*, 101*d* are image forming means for forming yellow (Y), magenta (M), cyan (C) and black (K) toner images, respectively. These image forming units are disposed in the order of the image forming units 101*a*, 101*b*, 101*c* and 101*d*, that is, in the order of yellow, magenta, cyan and black, from an upstream side with respect to a movement direction of an intermediary transfer belt 7.

The image forming units 101*a*, 101*b*, 101*c*, 101*d* include photosensitive drums 1*a*, 1*b*, 1*c*, 1*d* as photosensitive members (image bearing members), respectively, on which the toner images are formed. Primary chargers 2*a*, 2*b*, 2*c*, 2*d* are charging means for charging surfaces of the respective photosensitive drums 1*a*, 1*b*, 1*c*, 1*d*. Exposure devices 3*a*, 3*b*, 3*c*, 3*sd* are provided with laser scanners to expose to light the photosensitive drums 1*a*, 1*b*, 1*c* and 1*d* charged by the primary chargers. By outputs of the laser scanners being rendered on and off on the basis of image information, electrostatic images corresponding to images are formed on the respective photosensitive drums. That is, the primary charger and the exposure means function as electrostatic image forming means for forming the electrostatic image on the photosensitive drum. Developing devices 4*a*, 4*b*, 4*c* and 4*d* are provided with accommodating containers for accommodating the yellow, magenta, cyan and black toner and are developing means for developing the electrostatic images on the photosensitive drum 1*a*, 1*b*, 1*c* and 1*d* using the toner.

The toner images formed on the photosensitive drums 1*a*, 1*b*, 1*c*, 1*d* are primary-transferred onto an intermediary transfer belt 7 in primary-transfer portions N1*a*, N1*b*, N1*c* and N1*d* (primary-transfer positions). In this manner, four color toner images are transferred superimposedly onto the intermediary transfer belt 7. The primary-transfer will be described in detail hereinafter.

Photosensitive member drum cleaning devices 6*a*, 6*b*, 6*c* and 6*d* remove residual toner remaining on the photosensitive drums 1*a*, 1*b*, 1*c* and 1*d* without transferring in the primary-transfer portions N1*a*, N1*b*, N1*c* and N1*d*.

The intermediary transfer belt 7 (intermediary transfer member) is a movable intermediary transfer member onto which the toner images are to be transferred from the photosensitive drums 1*a*, 1*b*, 1*c*, 1*d*. In this embodiment, the intermediary transfer belt 7 has a two layer structure including a base layer and a surface layer. The base layer is at an inner side (inner peripheral surface side, stretching member side) and contacts the stretching member. The surface layer is at an outer surface side (outer peripheral surface side, image bearing member side) and contacts the photosensitive drum. The base layer comprises a resin material such as polyimide, polyamide, PEN, PEEK, or various rubbers, with a proper amount of an antistatic agent such as carbon black incorporated. The base layer of the intermediary transfer belt 7 is formed to have a volume resistivity of $10^2$-$10^7$ Ωcm thereof. In this embodiment, the base layer comprises the polyimide, having a center thickness of approx. 45-150 μm, in the form of a film-like endless belt. Further, as a surface layer, an acrylic coating having a volume resistivity of $10^{13}$-$10^{16}$ Ωcm in a thickness direction is applied. That is, the volume resistivity of the base layer is lower than that of the surface layer.

In the case where the intermediary transfer member has two or more layer structure, the volume resistivity of the outer peripheral surface side layer is higher than that of the inner peripheral surface side layer.

The thickness of the surface layer is 0.5-10 μm. Of course, the thickness is not intended to be limited to these numerical values.

The intermediary transfer belt 7 is stretched while contacting the intermediary transfer belt 7 by stretching rollers 10, 11 and 12 contacting the inner peripheral surface of the intermediary transfer belt 7. The roller 10 is driven by a motor as a driving source, thus functioning as a driving roller for driving the intermediary transfer belt 7. Further, the roller 10 is also an inner secondary-transfer roller urged toward the outer secondary-transfer roller 13 with the intermediary transfer belt. The roller 11 functions as a tension roller for applying a predetermined tension to the intermediary transfer belt 7. In addition, the roller 11 functions also as a correction roller for preventing snaking motion of the intermediary transfer belt 7. A belt tension to the tension roller 11 is constituted so as to be approx. 5-12 kgf. By this belt tension applied, nips as primary-transfer portions N1*a*, N1*b*, N1*c* and N1*d* are formed between the intermediary transfer belt 7 and the respective photosensitive drums 1*a*-1*d*. The inner secondary-transfer roller 62 is drive by a motor excellent in constant speed property, and functions as a driving roller for circulating and driving the intermediary transfer belt 7.

The recording material is accommodated in a sheet tray for accommodating the recording material P. The recording material P is picked up by a pick-up roller at predetermined timing from the sheet tray and is fed to a registration roller. In synchronism with the feeding of the toner image on the intermediary transfer belt, the recording material P is fed by the registration roller to the secondary-transfer portion N2 for transferring the toner image from the intermediary transfer belt onto the recording material.

The outer secondary-transfer roller 13 (transfer member) is a secondary-transfer member for forming the secondary-transfer portion N2 (secondary-transfer position) together with the inner secondary-transfer roller 13 by urging the inner secondary-transfer roller 10 via the intermediary transfer belt 7 from the outer peripheral surface of the intermediary transfer belt 7. The outer secondary-transfer roller 13 sandwiches the recording material together with the intermediary transfer belt at the secondary-transfer portion. A secondary-transfer high-voltage (power) source 22 as a secondary-transfer voltage source is connected to the outer secondary-transfer roller 13, and is a voltage source (power source) capable of applying a voltage to the outer secondary-transfer roller 13.

When the recording material P is fed to the secondary-transfer portion N2, a secondary-transfer electric field is formed by applying, to the outer secondary-transfer roller 13, the secondary-transfer voltage of an opposite polarity to the toner, so that the toner image is transferred from the intermediary transfer belt 7 onto the recording material.

Incidentally, the inner secondary-transfer roller 10 is formed with EPDM rubber. The inner secondary-transfer roller is set at 20 mm in diameter, 0.5 mm in rubber thickness and 70° in hardness (Asker-C). The outer secondary-transfer roller 13 includes an elastic layer formed of NBR rubber, EPDM rubber or the like, and a core metal. The outer secondary-transfer roller 13 is formed to have a diameter of 24 mm.

With respect to a direction in which the intermediary transfer belt 7 moves, in a downstream side than the secondary-transfer portion N2, an intermediary transfer belt cleaning device 14 for removing a residual toner and paper powder which remain on the intermediary transfer belt 7 without being transferred onto the recording material at the secondary-transfer portion N2 is provided.

[Primary-Transfer Electric Field Formation in Primary-Transfer-High-Voltage-Less-System]

This embodiment employs a constitution in which the voltage source exclusively for the primary-transfer is omitted for cost reduction. Therefore, in this embodiment, in order to electrostatically primary-transfer the toner image from the photosensitive drum onto the intermediary transfer belt 7, the secondary-transfer voltage source 22 is used (hereinafter, this constitution is referred to as a primary-transfer-high-voltage-less-system).

However, in a constitution in which the roller for stretching the intermediary transfer belt is directly connected to the ground, even when the secondary-transfer voltage source 210 applies the voltage to the outer secondary-transfer roller 64, there is a liability that most of the current flows into the stretching roller side, and the current does not flow into the photosensitive drum side. That is, even when the secondary-transfer voltage source 210 applies the voltage, the current does not flow into the photosensitive drums 50*a*, 50*b*, 50*c* and 50*d* via the intermediary transfer belt 56, so that the primary-transfer electric field for transferring the toner image does not act between the photosensitive drums and the intermediary transfer belt.

Therefore, in order to cause a primary-transfer electric field action to act in the primary-transfer-high-voltage-less-system, it is desirable that passive elements are provided between each of the stretching rollers 60, 61, 62 and 63 and the ground so as to pass the current toward the photosensitive drum side.

As a result, a potential of the intermediary transfer belt becomes high, so that the primary-transfer electric field acts between the photosensitive drum and the intermediary transfer belt.

Incidentally, in order to form the primary-transfer electric field in the primary-transfer-high-voltage-less-system, there is a need to pass the current along the circumferential direction of the intermediary transfer belt by applying the voltage from the secondary-transfer voltage source 210 (power source). However, if a resistance of the intermediary transfer belt itself is high, a voltage drop of the intermediary transfer belt with respect to a movement direction (circumferential direction) in which the intermediary transfer belt moves becomes large. As a result, there is also a liability that the current is less liable to pass through the intermediary transfer belt along the circumferential direction toward the photosensitive drums 1*a*, 1*b*, 1*c* and 1*d*. For that reason, the intermediary transfer belt may desirably have a low-resistant layer. In this embodiment, in order to suppress the voltage drop in the intermediary transfer belt, the base layer of the intermediary transfer belt is formed so as to have a surface resistivity of $10^2$ Ω/square or more and $10^8$ Ω/square or less. Further, in this embodiment, the intermediary transfer belt has the two-layer structure. This is because by disposing the high-resistant layer as the surface layer, the current flowing into a non-image portion is suppressed, and thus a transfer property is further enhanced easily. Of course, the layer structure is not intended to be limited to this structure. It is also possible to employ a single-layer structure or a structure of three layers or more.

Next, by using FIG. 2, a primary-transfer contrast which is a difference between the potential of the photosensitive drum and the potential of the intermediary transfer belt will be described.

Figure 2:
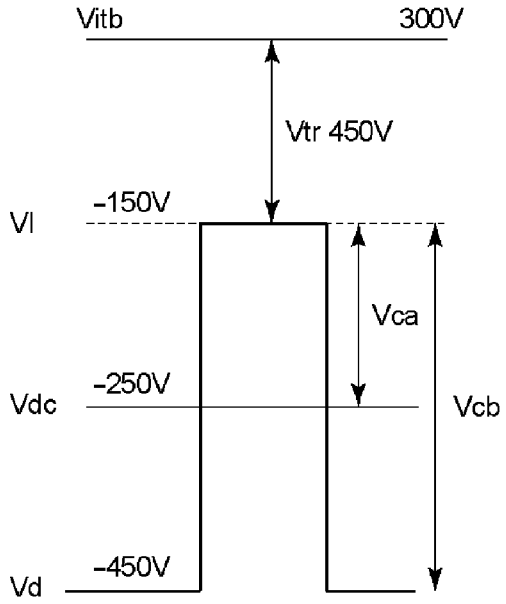
FIG. 2 is an illustration showing a relationship between a transferring potential and an electrostatic image potential.

FIG. 2 is the case where the surface of the photosensitive drum 1 is charged by the charging means 2, and the photosensitive drum surface has a potential Vd (−450 V in this embodiment). Further, FIG. 2 is the case where the surface of the charged photosensitive drum is exposed to light by the exposure means 3, and the photosensitive drum surface has Vl (−150 V in this embodiment). The potential Vd is the potential of the non-image portion where the toner is not deposited, and the potential Vl is the potential of an image portion where the toner is deposited. Vitb shows the potential of the intermediary transfer belt.

The surface potential of the drum is controlled on the basis of a detection result of a potential sensor provided in proximity to the photosensitive drum in a downstream side of the charging and exposure means and in upstream of the developing means.

The potential sensor detects the non-image portion potential and the image portion potential of the photosensitive drum surface, and controls a charging potential of the charging means on the basis of the non-image portion potential and controls an exposure light amount of the exposure means on the basis of the image portion potential.

By this control, with respect to the surface potential of the photosensitive drum, both potentials of the image portion potential and the non-image portion potential can be set at proper values.

With respect to this charging potential on the photosensitive drum, a developing bias Vdc (−250 V as a DC component in this embodiment) is applied by the developing device 4, so that a negatively charged toner is formed in the photosensitive drum side by development.

A developing contrast Vca which is a potential difference between the Vl of the photosensitive drum and the developing bias Vdc is: −150 (V)−(−250 (V))=100 (V).

An electrostatic image contrast Vcb which is a potential difference between the image portion potential Vl and the non-image portion potential Vd is: −150 (V)−(−450 (V))=300 (V).

A primary-transfer contrast Vtr which is a potential difference between the image portion potential Vl and the potential Vitb (300 V in this embodiment) of the intermediary transfer belt is: 300 V−(−150 (V))=450 (V).

Incidentally, in this embodiment, a constitution in which the potential sensor is disposed by attaching importance to accuracy of detection of the photosensitive drum potential is employed, but the present invention is not intended to be limited to this constitution. It is also possible to employ a constitution in which a relationship between the electrostatic image forming condition and the potential of the photosensitive drum is stored in ROM in advance by attaching importance to the cost reduction without disposing the potential sensor, and then the potential of the photosensitive drum is controlled on the basis of the relationship stored in the ROM.

[Zener Diode]

In the primary-transfer-high-voltage-less-system, the primary-transfer is determined by the primary-transfer contrast (primary-transfer electric field) which is the potential difference between the potential of the intermediary transfer belt and the potential of the photosensitive drum. For that reason, in order to stably form the primary-transfer contrast, it is desirable that the potential of the intermediary transfer belt is kept constant.

Therefore, in this embodiment, Zener diode is used as a constant-voltage element disposed between the stretching roller and the ground. Incidentally, in place of the Zener diode, a varister may also be used.

Figure 3:
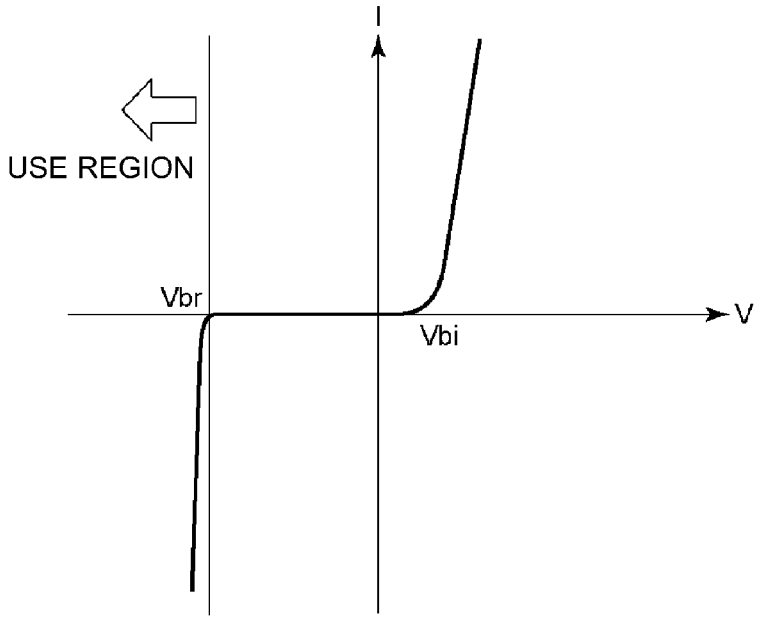
FIG. 3 is an illustration showing an IV characteristic of a Zener diode.

FIG. 3 shows a current-voltage characteristic of the Zener diode. The Zener diode causes the current to little flow until a voltage of Zener breakdown voltage Vbr or more is applied, but has a characteristic such that the current abruptly flows when the voltage of the Zener breakdown voltage or more is applied. That is, in a range in which the voltage applied to the Zener diode 15 is the Zener breakdown voltage (breakdown voltage) or more, the voltage drop of the Zener diode 15 is such that the current is caused to flow so as to maintain a Zener voltage.

By utilizing such a current-voltage characteristic of the Zener diode, the potential of the intermediary transfer belt 7 is kept constant.

That is, in this embodiment, the Zener diode 15 is disposed as the constant-voltage element between each of the stretching rollers 10, 11 and 12 and the ground.

In addition, during the primary-transfer, the secondary-transfer voltage source 22 applies the voltage so that the voltage drop of the Zener diode 15 maintains the Zener breakdown voltage. As a result, during the primary-transfer, the belt potential of the intermediary transfer belt 7 can be kept constant.

In this embodiment, between each of the stretching rollers and the ground, 12 pieces of the Zener diode 15 providing a standard value Vbr, of 25 V, of the Zener breakdown voltage are disposed in a state in which they are connected in series. That is, in the range in which the voltage applied to the Zener diode is kept at the Zener breakdown voltage, the potential of the intermediary transfer belt is kept constant at the sum of Zener breakdown voltages of the respective Zener diodes, i.e., 25×12=300 V.

Of course, the present invention is not intended to be limited to the constitution in which the plurality of Zener diodes are used. It is also possible to employ a constitution using only one Zener diode.

Of course, the surface potential of the intermediary transfer belt is not intended to be limited to a constitution in which the surface potential is 300 V. The surface potential may desirably be appropriately set depending on the species of the toner and a characteristic of the photosensitive drum.

In this way, when the voltage is applied by the secondary-transfer voltage source 210, the potential of the Zener diode maintains a predetermined potential, so that the primary-transfer electric field is formed between the photosensitive drum and the intermediary transfer belt. Further, similarly as the conventional constitution, when the voltage is applied by the secondary-transfer high-voltage source, the secondary-transfer electric field is formed between the intermediary transfer belt and the outer secondary-transfer roller.

[Controller]

Figure 4:
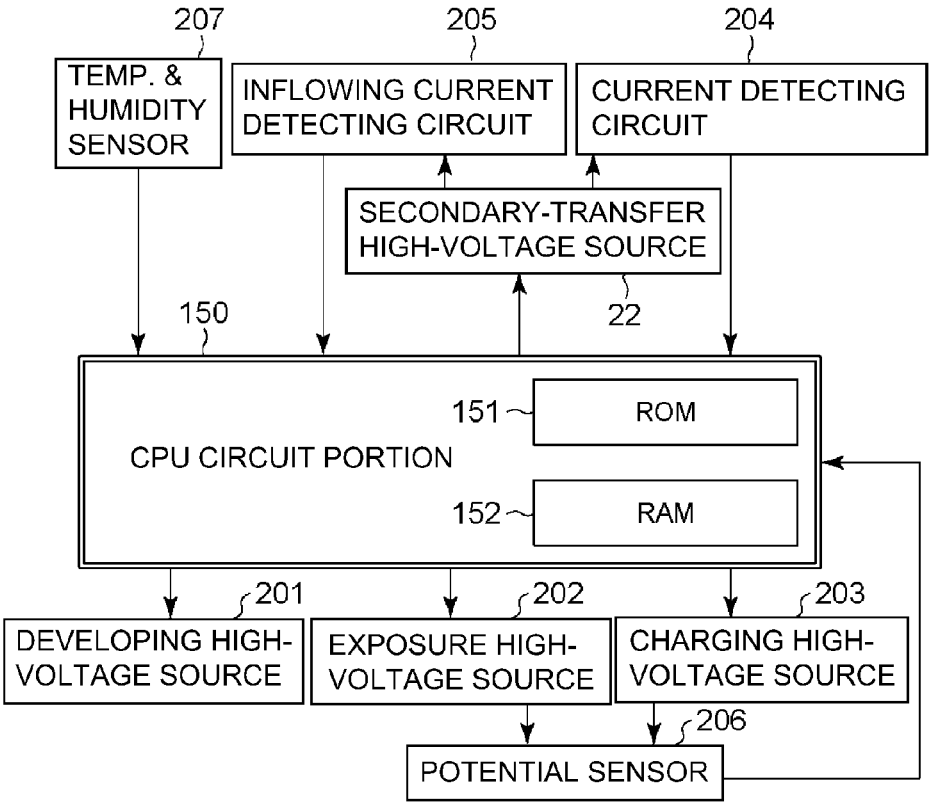
FIG. 4 is an illustration showing a block diagram of a control.

A constitution of a controller for effecting control of the entire image forming apparatus will be described with reference to FIG. 4. The controller includes a CPU circuit portion 150 (controller) as shown in FIG. 4. The CPU circuit portion 150 incorporates therein CPU, ROM 151 and RAM 152. A secondary-transfer portion current detecting circuit 204 is a circuit (detecting portion, first detecting portion) for detecting a current passing through the outer secondary-transfer roller. A stretching-roller-inflowing-current detecting circuit 205 (second detecting portion) is a circuit for detecting a current flowing into the stretching roller. A potential sensor 206 is a sensor for detecting the potential of the photosensitive drum surface. A temperature and humidity sensor 207 is a sensor for detecting a temperature and a humidity.

Into the CPU circuit portion 150, information from the secondary-transfer portion current detecting circuit 204, the stretching-roller-inflowing-current detecting circuit 205, the potential sensor 206 and the temperature and humidity sensor 207 is inputted. Then, the CPU circuit portion 150 effects integral control of the secondary-transfer voltage source 22, a developing high-voltage source 201, an exposure means high-voltage source 202 and a charging means high-voltage source 203 depending on control programs stored in the ROM 151. An environment table and a recording material thickness correspondence table which are described later are stored in the ROM 151, and are called up and reflected by the CPU. The RAM 152 temporarily hold control data, and is used as an operation area of arithmetic processing with the control.

[Discriminating Function]

In this embodiment, in order to make the surface potential of the intermediary transfer belt not less than the Zener voltage, a step for discriminating a lower-limit voltage of the voltage applied by the secondary-transfer voltage source is executed. Description will be made using FIG. 5.

In this embodiment, in order to discriminate the lower-limit voltage, the stretching-roller-inflowing-current detecting circuit (second detecting portion) for detecting the current flowing into the ground via the Zener diode 15 is used. The stretching-roller-inflowing-current detecting circuit is connected between the Zener diode and the ground. That is, each of the stretching rollers are connected to the ground potential via the Zener diode and the stretching-roller-inflowing-current detecting circuit.

As shown in FIG. 3, the Zener diode has a characteristic such that the current little flows in a range in which the voltage drop of the Zener diode is less than the Zener breakdown voltage. For that reason, when the stretching-roller-inflowing-current detecting circuit does not detect the current, it is possible to discriminate that the voltage drop of the Zener diode is less than the Zener breakdown voltage. Further, when the stretching-roller-inflowing-current detecting circuit detects the current, it is possible to discriminate that the voltage drop of the Zener diode maintains the Zener breakdown voltage.

First, charging voltages for all the stations for Y, M, C and Bk are applied, so that the surface potential of the photosensitive drum is controlled at the non-image portion potential Vd.

Figure 5:
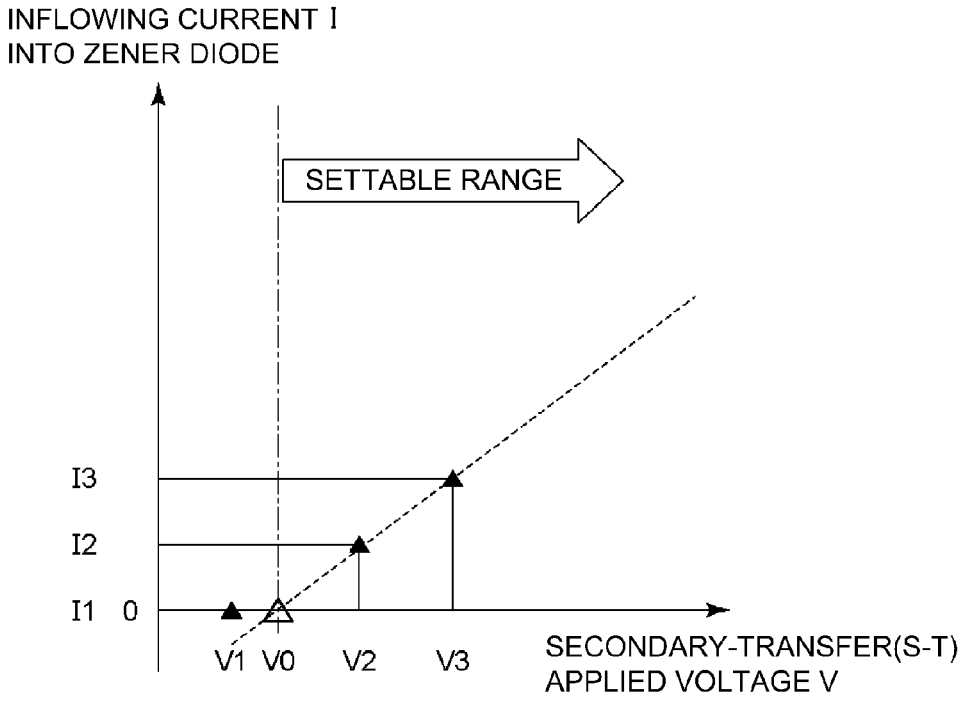
FIG. 5 is an illustration showing a relation between an inflowing current and an applied voltage.

Next, the secondary-transfer voltage source applies a test voltage. The test voltage applied by the secondary-transfer voltage source is increased linearly or stepwisely. In FIG. 5, the test voltage is increased stepwisely in the order of V1, V2 and V3. When the voltage applied by the secondary-transfer voltage source is V1, the stretching-roller-inflowing-current detecting circuit does not detect the current (I1=0 μA). When the voltage applied by the secondary-transfer voltage source is V2 and V3, the stretching-roller-inflowing-current detecting circuit detects I2 μA or I3 μA, respectively. Here, from a correlation between an applied voltage and a detected current in the case where the stretching-roller-inflowing-current detecting circuit detects the current, a current inflowing starting voltage V0 corresponding to the case where the current starts to flow into the Zener diode is calculated. That is, from a relationship among I2, I3, V2 and V3, by performing linear interpolation, the current inflowing starting voltage V0 is carried.

As the voltage applied by the secondary-transfer voltage source, by setting a voltage exceeding V0, the voltage drop of the Zener diode can be made so as to maintain the Zener breakdown voltage.

Figure 6:
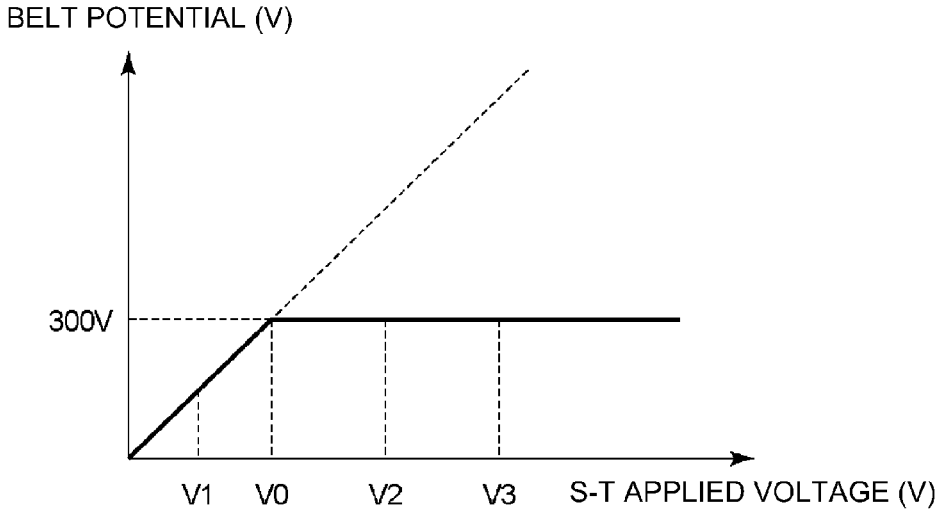
FIG. 6 is an illustration showing a relation between a belt potential and an applied voltage.

A relationship, at this time, between the voltage applied by the secondary-transfer voltage source and the belt potential of the intermediary transfer belt is shown in FIG. 6.

For example, in this embodiment, the Zener voltage of the Zener diode is set at 300 V. For that reason, in a range in which the potential of the intermediary transfer belt is less than 300 V, the current does not flow into the Zener diode, and when the belt potential of the intermediary transfer belt is 300 V, the current starts to flow into the Zener diode. Even when the voltage applied by the secondary-transfer voltage source is increased further, the belt potential of the intermediary transfer belt is controlled so as to be constant.

That is, in a range of less than V0 at which the flow of the current into the Zener diode is started to be detected, when the secondary-transfer bias is changed, the potential of the intermediary transfer belt cannot be controlled at the constant voltage. In a range exceeding V0 at which the flow of the current into the Zener diode is started to be detected, even when the secondary-transfer bias is changed, the potential of the intermediary transfer belt can be controlled at the constant voltage.

Incidentally, in this embodiment, before and after the current inflowing starting voltage are used as the test voltage, but the present invention is not intended to be limited to this constitution. As the test voltage, by setting a larger predetermined voltage in advance, it is also possible to employ a constitution in which all the test voltages exceeds the current inflowing starting voltage. In such a constitution, there is an advantage such that a discriminating step can be omitted.

Incidentally, in this embodiment, by attaching importance to enhancement of accuracy of calculation of the current inflowing starting voltage, a constitution in which a discriminating function for calculating the current inflowing starting voltage V0 is executed is employed. Of course, the present invention is not intended to be limited to this constitution. By attaching important to suppression of long downtime, not the constitution in which the discriminating function for calculating the current inflowing starting voltage V0 is executed, it is also possible to employ a constitution in which the current inflowing starting voltage V0 is stored in the ROM in advance.

[Test Mode for Setting Secondary-Transfer Voltage]

In this embodiment, in order to set the secondary-transfer voltage at which the toner image is to be transferred onto the recording material, a test mode which is called ATVC (Active Transfer Voltage Control) in which an adjusting voltage (test voltage) is applied is executed. This is a test mode for setting the secondary-transfer voltage and is executed when no recording material exists at the secondary-transfer portion. There is also a case where this test mode is executed when an intermediary transfer belt region corresponding to a region between recording materials is in the secondary-transfer position in the case where the images are continuously formed. By the ATVC, it is possible to grasp a correlation between the voltage applied by the secondary-transfer voltage source and the current passing through the secondary-transfer portion.

Incidentally, the ATVC is carried out by controlling the secondary-transfer voltage source by the CPU circuit portion 150 when no recording material exists at the secondary-transfer portion. That is, the CPU circuit portion 150 functions as an executing portion for executing the ATVC for setting the secondary-transfer voltage.

In the ATVC, a plurality of adjusting voltages Va, Vb and Vd which are constant-voltage-controlled are applied by the secondary-transfer voltage source. Then, in the ATVC, currents Ia, Ib and Ic flowing when the adjusting voltages are applied are detected, respectively, by the secondary-transfer portion current detecting circuit 204 (detecting portion, first detecting portion). As a result, the correlation between the voltage and the current can be grasped.

[Secondary-Transfer Target Current Setting]

On the basis of a correlation between the plurality of applied adjusting voltages, Va, Vb and Vc and the measured currents Ia, Ib and Ic, a voltage Vi for causing a secondary-transfer target current It required for the secondary-transfer to flow is calculated. The secondary-transfer target current It is set on the basis of a matrix shown in Table 1.

TABLE 1

| | WC*1 (g/kg) | | | | | | |
|---|---|---|---|---|---|---|---|
| | 0.8 | 2 | 6 | 9 | 15 | 18 | 22 |
| STTC*2 (μA) | 32 | 31 | 30 | 30 | 29 | 28 | 25 |

*1"WC" represents water content.
*2"STTC" represents the secondary-transfer target current.

Table 1 is a table stored in a storing portion provided in the CPU circuit portion 150. This table sets and divides the secondary-transfer target current It depending on absolute water content (g/kg) in an atmosphere. This reason will be described. When the water content becomes high, a toner charge amount becomes small. Therefore, when the water content becomes high, the secondary-transfer target current It is set so as to become small. That is, when the water content is increased, the secondary-transfer target current is decreased. Incidentally, the absolute water content is calculated by the CPU circuit portion 150 from the temperature and relative humidity which are detected by the temperature and humidity sensor 207. Incidentally, in this embodiment, the absolute water content is used, but the water content is not intended to be limited to this. In place of the absolute water content, it is also possible to use relative humidity.

Here, the voltage Vi for passing It is a voltage for passing It in the case where no recording material exists at the secondary-transfer portion. However, the secondary-transfer is carried out when the recording material exists at the secondary-transfer portion. Therefore, it is desirable that a resistance for the recording material is taken into account. Therefore, a recording material sharing voltage Vii is added to the voltage Vi. The recording material sharing voltage Vii is set on the basis of a matrix shown in Table 2.

TABLE 2

| | | WC*1 | | | | | | |
|---|---|---|---|---|---|---|---|---|
| | | 0.8 | 2 | 6 | 9 | 15 | 18 | 22 |
| PLAIN PAPER | | | | | | | | |
| 64-79 (gsm) (UNIT: V) | OS*2 | 900 | 900 | 850 | 800 | 750 | 500 | 400 |
| | ADS*3 | 1000 | 1000 | 950 | 900 | 850 | 750 | 500 |
| | MDS*4 | 1000 | 1000 | 950 | 900 | 850 | 750 | 500 |
| 80-105 (gsm) | | | | | | | | |
| (UNIT: V) | OS*2 | 950 | 950 | 900 | 850 | 800 | 550 | 450 |
| | ADS*3 | 1050 | 1050 | 1000 | 950 | 900 | 800 | 550 |
| | MDS*4 | 1050 | 1050 | 1000 | 950 | 900 | 800 | 550 |

TABLE 2-continued

| | | WC*1 | | | | | | |
|---|---|---|---|---|---|---|---|---|
| | | 0.8 | 2 | 6 | 9 | 15 | 18 | 22 |
| 106-128 (gsm) | | | | | | | | |
| (UNIT: V) | OS*2 | 1000 | 1000 | 950 | 900 | 850 | 600 | 500 |
| | ADS*3 | 1100 | 1100 | 1050 | 1000 | 950 | 850 | 600 |
| | MDS*4 | 1100 | 1100 | 1050 | 1000 | 950 | 850 | 600 |
| 129-150 (gsm) | | | | | | | | |
| (UNIT: V) | OS*2 | 1050 | 1050 | 1000 | 950 | 900 | 650 | 550 |
| | ADS*3 | 1150 | 1150 | 1100 | 1050 | 1000 | 900 | 650 |
| | MDS*4 | 1150 | 1150 | 1100 | 1050 | 1000 | 900 | 650 |

*1"WC" represent the water content.
*2"OS" represents one side (printing).
*3"ADS" represents automatic double side (printing).
*4"MDS" represents manual double side (printing).

Table 2 is a table stored in the storing portion provided in the CPU circuit portion 150. This table sets and divides the recording material sharing voltage Vii depending on the absolute water content (g/kg) in an atmosphere and a recording material basis weight (g/m$^2$). When the basis weight is increased, the recording material sharing voltage Vii is increased. This is because when the basis weight is increased, the recording material becomes thick and therefore an electric resistance of the recording material is increased. Further, when the absolute water content is increased, the recording material sharing voltage Vii is decreased. This is because when the absolute water content is increased, the content of water contained in the recording material is increased, and therefore the electric resistance of the recording material is increased. Further, the recording material sharing voltage Vii is larger during automatic double-side printing and during manual double-side printing than during one-side printing. Incidentally, the basis weight is a unit showing a weight per unit area (g/m$^2$), and is used in general as a value showing a thickness of the recording material. With respect to the basis weight, there are the case where a user inputs the basis weight at an operating portion and the case where the basis weight of the recording material is inputted into the accommodating portion for accommodating the recording material. On the basis of these pieces of information, the CPU circuit portion 150 discriminate the basis weight.

A voltage (Vi+Vii) obtained by adding the recording material sharing voltage Vii to Vi for passing the secondary-transfer target current It is set, by the CPU circuit portion 150, as a secondary-transfer target voltage Vt, for secondary-transfer, which is constant-voltage-controlled. That is, the CPU circuit portion 150 functions as a controller for controlling the secondary-transfer voltage. As a result, a proper voltage value is set depending on an adjusting voltage environment and paper thickness. Further, during the secondary-transfer, the secondary-transfer voltage set by the CPU circuit portion 150 is applied in a constant-voltage-controlled state, and therefore even when a width of the recording material is changed, the secondary-transfer is carried out in a stable state.

[Setting of a Secondary-Transfer Voltage Corresponding to Maximum-Width Recording Material]

In order to suppress prolonged downtime, it is desirable that the primary-transfer and the secondary-transfer are carried out in parallel. However, when the primary-transfer and the secondary-transfer are carried out in parallel, if the voltage drop of the Zener diode is less than the Zener breakdown voltage, there is a liability that the primary-transfer is unstable.

Therefore, when the recording material passes through the secondary-transfer portion, it is desirable that the voltage drop of the Zener diode maintains the Zener breakdown voltage.

Figure 7:
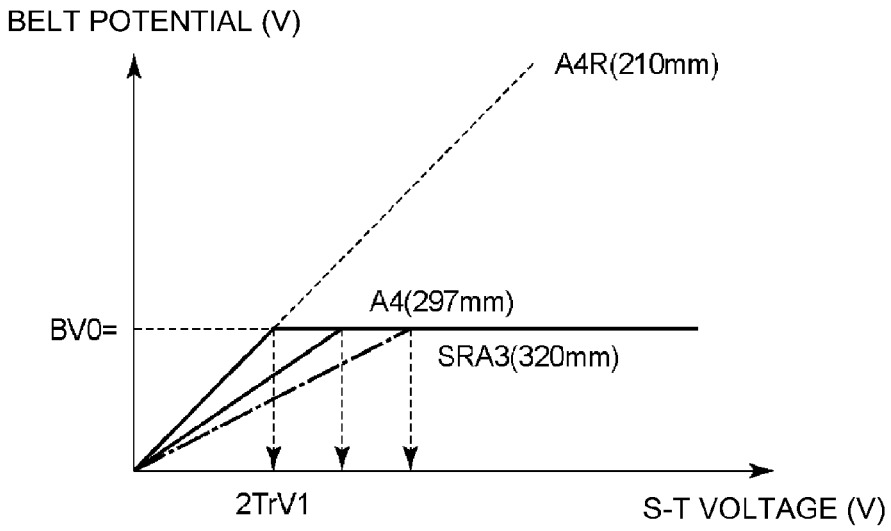
FIG. 7 shows a relationship between a width of a recording material and a belt potential.

However, in the primary-transfer-high-voltage-less system, as shown in FIG. 7, depending on a width of the recording material with respect to a widthwise direction at the secondary-transfer portion, a relationship between the voltage to be applied to the secondary-transfer member and the belt potential. Here, the widthwise direction is a direction perpendicular to a feeding direction in which the recording material is fed. FIG. 7 shows a relationship, with respect to the recording material of a predetermined species (plain paper), between a secondary-transfer applied voltage and the belt potential for A4R (widthwise direction: 210 mm), A4 (widthwise direction: 297 mm) and SRA3 (320 mm) as representative recording material widths. As shown in FIG. 7, even when the species of the recording material is the same, with an increasing width with respect to the widthwise direction, a voltage necessary to keep the belt potential constant becomes larger.

This reason will be described. This is because a contact width between the secondary-transfer roller and the intermediary transfer belt varies depending on the width of the recording material with respect to the widthwise direction as shown in FIG. 8.

In this embodiment, a width of the intermediary transfer belt is 344 mm, a width of the outer secondary-transfer roller is 323 mm, and a width of the inner secondary-transfer roller is 329 mm, and the recording material is fed on the basis of a center of these members with respect to the widthwise direction as a reference.

Figure 8:
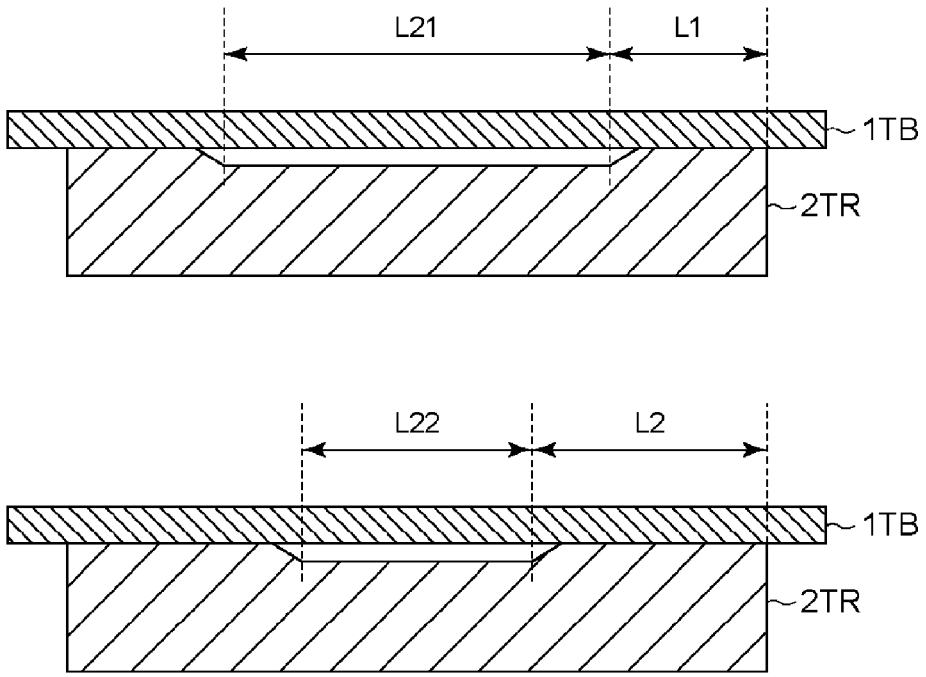
FIG. 8 shows a relationship between a recording material passing region and a recording material non-passing region.

(a) of FIG. 8 is a view showing the recording material width at A3 width and the contact width between the intermediary transfer belt and the outer secondary-transfer roller in a non-passing region where the recording material does not pass. As shown in the figure, a width L21 (width: 320 mm) of the recording material, and a contact width L1 between the outer secondary-transfer roller (width: 323 mm) and the intermediary transfer belt (width: 344 mm) are shown. Next, (b) of FIG. 8 is a view showing the recording material width at A4R width and the contact width between the intermediary transfer belt and the outer secondary-transfer roller in the non-passing region. As shown in the figure, a recording material width L22 and a contact width L2 between the outer secondary-transfer roller and the intermediary transfer belt. In this way, by a difference in contact width between the intermediary transfer belt and the outer secondary-transfer roller due to the recording material width with respect to the widthwise direction, a relationship between a secondary-transfer bias to be applied to the outer secondary-transfer roller and the belt potential of the intermediary transfer belt varies.

In the case where the width of the recording material is small, i.e., in the case where the contact width is large, a current in a large amount flows outside the recording material. For that reason, there is a tendency that a voltage exerted on the Zener diode becomes large. On the other hand, in the case where the width of the recording material is large, i.e., in the case where the contact width is small, the current flowing outside the recording material becomes small. For that reason, there is a tendency that the voltage exerted on the Zener diode becomes small. In this way, when a width (area) in which the secondary-transfer roller and the intermediary transfer belt direct contact is changed, the relationship between the voltage applied to the secondary-transfer member and the belt potential is different depending on the width of the recording material.

In the case where the width of the recording material is large, if the voltage exerted on the Zener diode becomes small, there is a liability that the voltage drop of the Zener diode is less than the Zener breakdown voltage. As a result, the transfer contrast at the primary-transfer portion is low, and therefore the case where the primary-transfer defect generates exists.

Therefore, in this embodiment, with respect to the recording materials with all the widths, the secondary-transfer voltage corresponding to the width (area), in which the secondary-transfer roller and the intermediary transfer belt, determined depending on the recording material with a maximum width is set. Incidentally, the recording material of the maximum width is the recording material with the maximum width of regular widths with which the image forming apparatus is compatible, and is determined in advance. In this embodiment, regular sizes with which the image forming apparatus is compatible are A4R (widthwise direction: 210 mm), A4 (widthwise direction: 297 mm) and SRA3 (320 mm), and therefore the recording material with the maximum width is SRA3.

Of the relationship between the applied voltage and the belt potential shown in FIG. 7, an added voltage value of the recording material is calculated on the basis of the relationship between the applied voltage and the belt potential in the case where the recording material (SRA3) with the maximum width is fed. The calculated voltage value is stored, as the added voltage value for all the sizes of plain paper, in the ROM 151 of the controller 20. In the case where the plain paper is fed, irrespective of the width of the recording material, the added voltage value is added, as a value corresponding to a change in resistance by the recording material, to a voltage value corresponding to a target current. Thus, the secondary-transfer voltage is obtained.

The added voltage for the recording material to be added for obtaining the secondary-transfer voltage is calculated from the relationship of the case where the maximum-width recording material is fed, and therefore even in the case where the recording material with any width is fed, it is suppressed that the voltage exerted on the Zener diode becomes low. Incidentally, setting of the added voltage for the recording material is similarly made also with respect to the recording materials of other species. That is, also with respect to the recording materials of other species, on the basis the relationship in the case where the maximum-width recording material is fed, the added voltage for the recording material is calculated.

Figure 9:
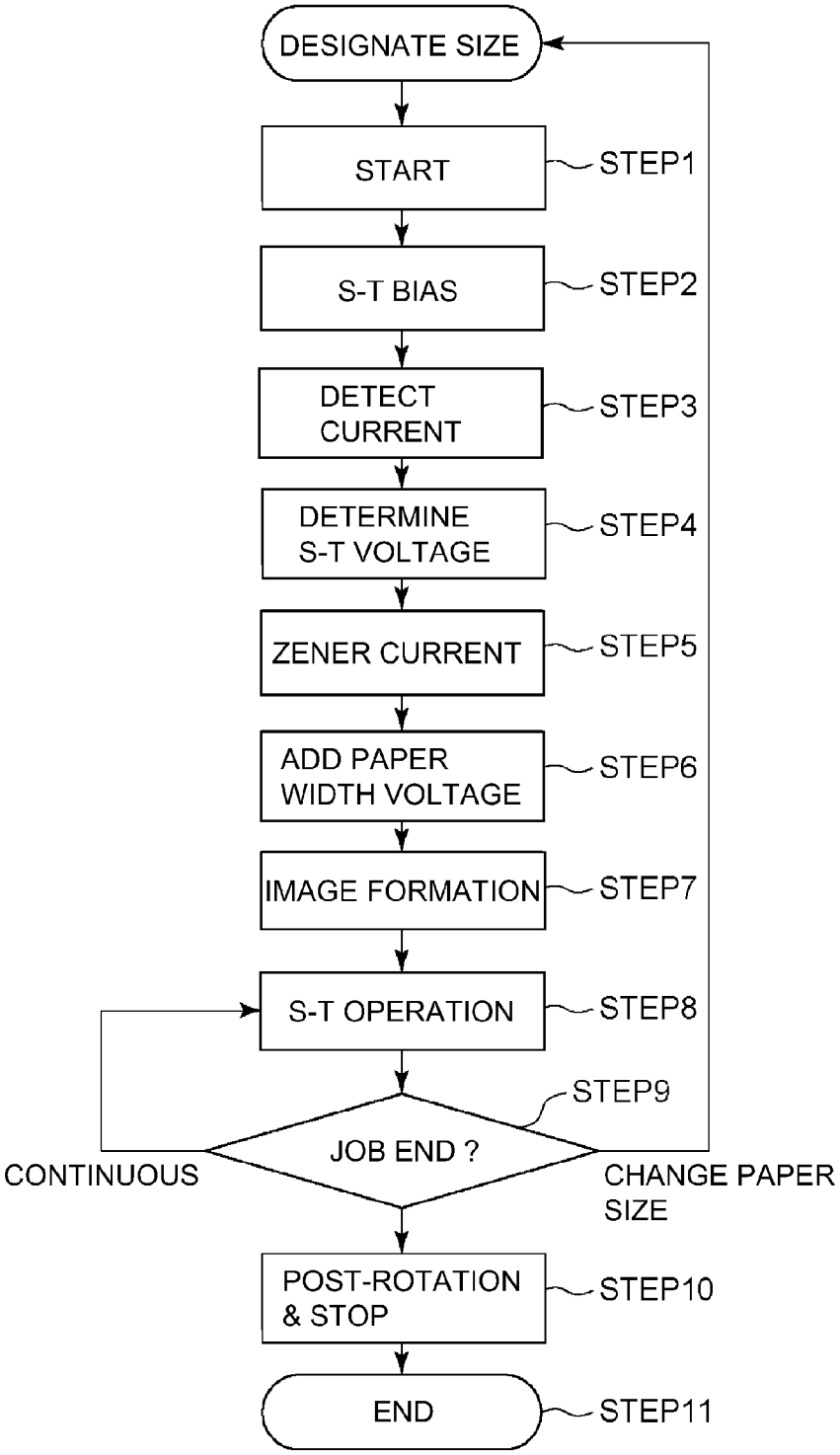
FIG. 9 is a flowchart in Embodiment 1.

FIG. 9 shows a flowchart.

In advance of an operation of the image forming apparatus, by an instruction from a user, a size and species of the recording material to be used are selected from a touch panel or the like (Step 1). Next, a start button of the image forming apparatus is pushed (Step 2), and when the CPU circuit portion 150 starts the image forming operation, the CPU circuit portion 150 starts a flow of secondary-transfer bias determination in a state in which the recording material is not fed. First, the CPU circuit portion 150 applies a plurality of secondary-transfer biases to the secondary-transfer portion (Step 3). The CPU circuit portion 150 determines the secondary-transfer voltage corresponding to the target current from a detected current corresponding to the applied voltage (Step 4). Further, the CPU circuit portion 150 detects the Zener diode in flowing current at the secondary-transfer voltage determined in Step 4, and then checks whether or not the secondary-transfer voltage is within a region where the belt potential is constant (Step 5).

The CPU circuit portion 150 adds the voltage value, determined depending on the recording material species stored in advance, to the voltage value determined by Step 4 (Step 6). The CPU circuit portion 150 applies, to the secondary-transfer roller, the voltage value added in Step 6 as the secondary-transfer voltage in synchronism with recording material feeding timing (Step 7), so that a secondary-transfer operation in which the toner image is transferred from the intermediary transfer belt onto the recording material is performed (Step 8). Next, if the recording materials are continuously fed, the CPU circuit portion 150 returns to Step 6 (Step 8), and if the recording material species is changed, the CPU circuit portion 150 returns to Step 1 (Step 9). If the operation ends as it is, the CPU circuit portion 150 ends the image forming operation (Step 10).

By the above, in the constitution of the primary-transfer-high-voltage-less system, with respect to the recording materials with all the widths, the applied voltage to the secondary-transfer roller is determined depending on the maximum recording material width, so that it is possible to prevent transfer defect due to short of the transfer contrast at the primary-transfer portion when the toner image is secondary-transferred onto the recording material.

Embodiment 2

Overlapping points with Embodiment 1 will be omitted from description. A different point from Embodiment 1 will be described.

In Embodiment 1, the voltage determined on the basis of the maximum width of the recording material is used for obtaining the secondary-transfer voltage even when the width of the recording material to be fed is any width. There is no need to set the voltage every width of the recording material, and therefore there is an advantage such that the setting is simplified. In Embodiment 2, the voltage value determined depending on the width of the recording material is selected depending on the size of the recording material to be fed, and is used for obtaining the secondary-transfer voltage. There is an advantage such that application of a voltage, more than necessary, to the secondary-transfer roller is suppressed to prolong a lifetime of the secondary-transfer roller.

In this embodiment, the secondary-transfer roller is adjusted s that a resistance value thereof is a value of about $1\times10^{6}$-$1\times10^{10}$ (Ω). As a rubber material, a general-purpose rubber such as nitrile-butadiene rubber (NBR), ethylene-propylene rubber (EPM, EPDM) or epichlorohydrin rubber (CO, ECO) and a foam member thereof. Further, as an electroconductive material, one in which a material of an ion-conduction type is mixed is used.

With respect to a resistance of the transfer roller of this ion-conduction type, it has been known that the resistance is liable to fluctuate depending on a temperature and humidity, an energization time and an applied voltage in the machine. If the voltage applied to the secondary-transfer roller is high, there is a liability that resistance rise of the outer secondary-transfer roller is accelerated to result in shorter lifetime.

Therefore, it is desirable that the lifetime of the secondary-transfer roller is prolonged by selecting the secondary-transfer applied voltage depending on the recording material width.

Figure 10:
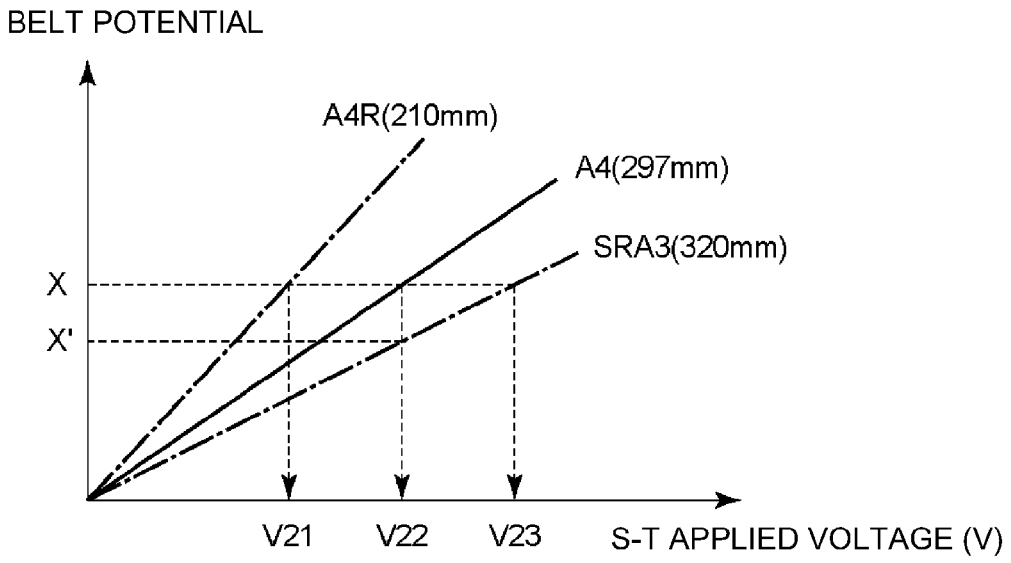
FIG. 10 shows a relationship between the width of the recording material and an applied voltage.

FIG. 10 is a graph for illustrating the relationship between the secondary-transfer voltage and the belt potential. Here, for simplification of description, the description will be made by narrowing down the recording material width to the representative recording material width.

As shown in FIG. 10, with respect to A4R, A4 and SRA3, the relationship of the belt potential with the secondary-transfer bias is different as described also in Embodiment 1.

Here, the secondary-transfer bias corresponding to A4R is V21, the secondary-transfer bias corresponding to A3 is V22, and the secondary-transfer bias corresponding to SRA3 is V23.

Therefore, the added voltage for the recording material is determined every width of the recording material. That is, setting of the added voltage is different depending on the recording material. Even when the species is the same, the setting is made so that the added voltage for the recording material with a small width is small and the added voltage for the recording material with a large width is large. In addition, each of the added voltages is added, as a value corresponding to a change in resistance by the recording material, to a voltage value corresponding to a target current. Thus, the secondary-transfer voltage is obtained.

In this embodiment, the recording material added voltage to be added to the secondary-transfer voltage is the voltage value calculated on the basis of a relationship in the case where the recording material with each of widths is fed. Even in the case where the recording material with any of widths is fed, a lowering in voltage exerted on the Zener diode is suppressed.

The added voltage for the recording material to be added for obtaining the secondary-transfer voltage is calculated from the relationship of the case where the recording material with each of widths is fed, and therefore even in the case where the recording material with any width is fed, it is suppressed that the voltage exerted on the Zener diode becomes low.

Figure 11:
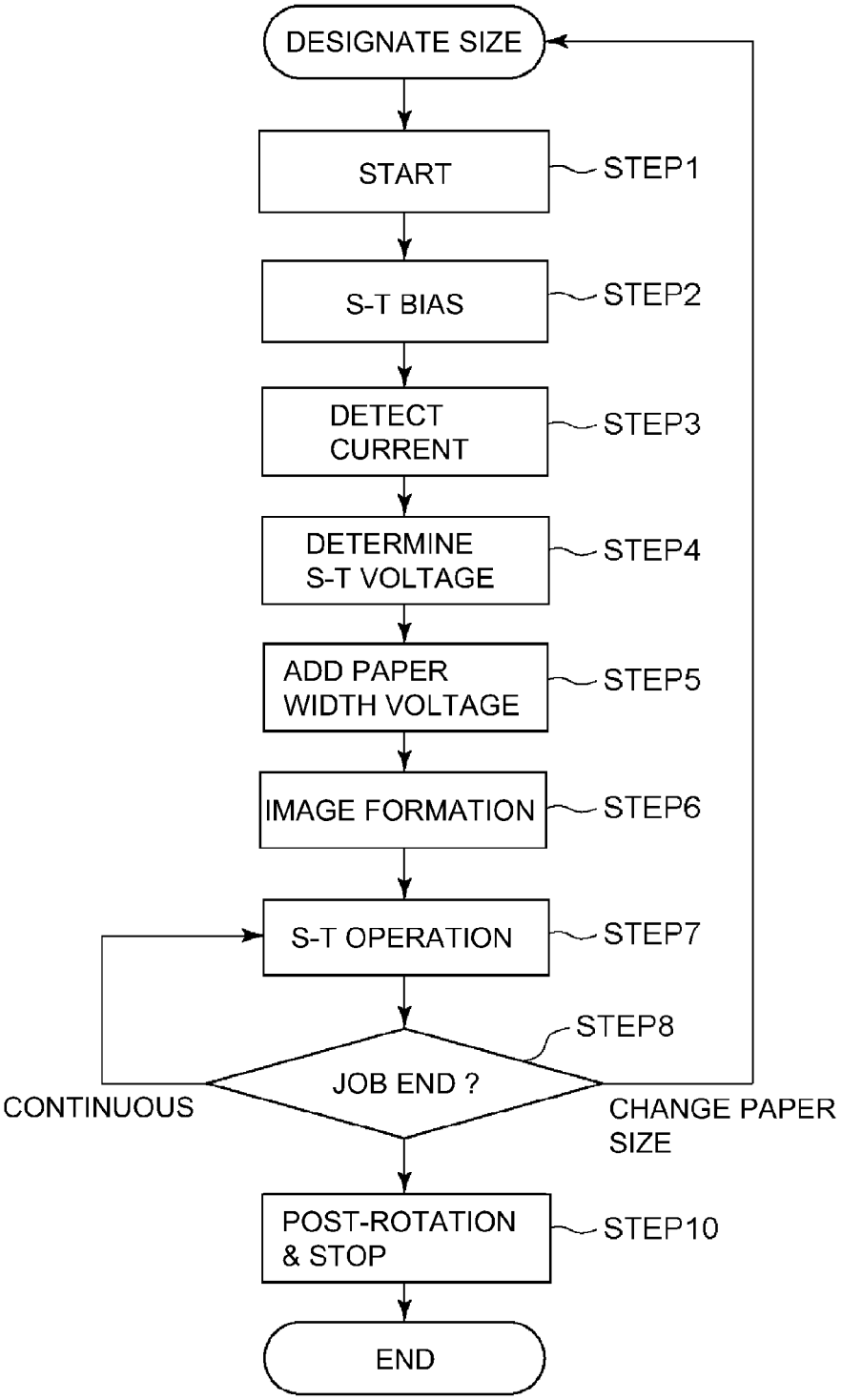
FIG. 11 shows a flowchart in Embodiment 2.

FIG. 11 shows a flowchart.

In advance of an operation of the image forming apparatus, by an instruction from a user, a size and species of the recording material to be used are selected from a touch panel or the like (Step 1). Next, a start button of the image forming apparatus is pushed (Step 2), and when the CPU circuit portion 150 starts the image forming operation, a flow of secondary-transfer bias determination is started, in a state in which the recording material is not fed. First, the CPU circuit portion 150 applies a plurality of secondary-transfer biases to the secondary-transfer portion (Step 3). The CPU circuit portion 150 determines the secondary-transfer voltage corresponding to the target current from a detected current corresponding to the applied voltage (Step 4). Further, the CPU circuit portion 150 detects the Zener diode in flowing current at the secondary-transfer voltage determined in Step 4, and then checks whether or not the belt potential is stable (Step 5).

Here, depending on the recording material width selected in Step 1, the CPU circuit portion 150 adds the voltage value, determined depending on the recording material species stored in advance, to the voltage value determined by Step 4 (Step 6). The CPU circuit portion 150 applies, to the secondary-transfer roller, the voltage value added in Step 6 as the secondary-transfer voltage in synchronism with recording material passing timing (Step 7), so that a secondary-transfer operation in which the toner image is transferred from the intermediary transfer belt onto the recording material is performed (Step 8). Next, if the recording materials are continuously fed, the CPU circuit portion 150 returns to Step 7 (Step 9), and if the species of the recording material is changed, the CPU circuit portion 150 returns to Step 1 (Step 10). If the operation ends as it is, the CPU circuit portion 150 ends the image forming operation (Step 11).

The above is Embodiment 2, but the width of the selected recording material species with respect to the widthwise direction can also be detected automatically by placing a recording material width detecting sensor in a feeding path from a tray for the recording material to the secondary-transfer portion.

Further, in Embodiment 1 and Embodiment 2, a constitution in which the secondary-transfer voltage is selected before the image formation is employed. However, the present invention is not intended to be limited to this constitution. It is also possible to combine control, in which a Zener in flowing current is detected when the recording material passes through the secondary-transfer portion and then the secondary-transfer voltage is corrected every detection, with this constitution. In the case where there is no value of the current flowing into the Zener diode during the passing of the recording material through the secondary-transfer portion, this means that the belt potential does not reach the Zener potential, and therefore in order to increase the belt potential, it is also possible to subject the secondary-transfer voltage to feed-back.

By the above, in this embodiment, even in the case where the recording material with the maximum width is fed, it is possible to compatibly realize the primary-transfer and the secondary-transfer. Further, the voltage depending on the recording material width is selected, and therefore even when the recording materials with a small width are continuously passed in the widthwise direction, it is possible to suppress the resistance rise of the secondary-transfer roller.

Incidentally, in this embodiment, the image forming apparatus for forming the electrostatic image by the electrophotographic type is described, but this embodiment is not intended to be limited to this constitution. It is also possible to use an image forming apparatus for forming the electrostatic image by an electrostatic force type, not the electrophotographic type.

INDUSTRIAL APPLICABILITY

The controller controls the voltage to be applied to the transfer member when the recording material having the predetermined largest width exists at the secondary-transfer position, so that the constant-voltage element maintains the predetermined voltage, whereby it is possible to prevent transfer defect due to short of the primary-transfer electric field at the primary-transfer portion when the toner image is secondary-transferred onto the recording material.

The invention claimed is:

1. An image forming apparatus comprising:

an image bearing member configured to bear a toner image;

an intermediary transfer member configured to carry the toner image primary-transferred from the image bearing member at a primary-transfer position;

a transfer member, provided contactable to an outer peripheral surface of the intermediary transfer member, configured to secondary-transfer the toner image from the intermediary transfer member onto a recording material at a secondary-transfer position;

a constant-voltage element, electrically connected between the intermediary transfer member and a ground potential, configured to maintain a predetermined voltage by passing of a current therethrough;

a power source configured to form, by applying a voltage to the transfer member to pass the current through the constant-voltage element, both of a secondary-transfer electric field at the secondary-transfer position and a primary-transfer electric field at the primary-transfer position; and a controller configured to control a voltage to be applied to the transfer member by the power source when the toner image is secondary-transferred onto the recording material having a predetermined largest width with respect to a widthwise direction perpendicular to a feeding direction, so that the constant-voltage element maintains the predetermined voltage.

2. An image forming apparatus according to claim 1, wherein the controller controls the voltage, to be applied to the transfer member by the power source when the toner image is secondary transferred onto the recording material, so that the constant-voltage element maintains the predetermined voltage, irrespective of a paper species of the recording material.

3. An image forming apparatus according to claim 1, wherein in the case where the recording material is the same species as the recording material having the largest width, the controller controls the voltage to be applied to the transfer member by the power source when the toner image is secondary-transferred onto the recording material, by the voltage to be applied to the transfer member by the power source when the toner image is secondary-transferred onto the recording material having the largest width, irrespective of a width of the recording material.

4. An image forming apparatus according to claim 1, wherein in the case where the recording material is the same species as the recording material having the largest width, the controller controls the voltage to be applied to the transfer member by the power source when the toner image is secondary-transferred onto the recording material having a first width, so as to be lower than a voltage which is a voltage at which the constant-voltage element maintains the predetermined voltage and which is to be applied to the transfer member by the power source when the toner image is secondary-transferred onto the recording material having a second width which is wider than the first width and which is not more than the recording material having the largest width.

5. An image forming apparatus according to claim 1, wherein widths with respect to the widthwise direction have the following relationship:

the intermediary transfer member>the transfer member>the recording material having the largest width.

6. An image forming apparatus according to claim 1, comprising an inputting portion capable of inputting information on the recording material, wherein said controller controls the power source on the basis of a value depending on the information on the recording material.

7. An image forming apparatus according to claim 6, wherein the information on the recording material is information on a species of the recording material.

8. An image forming apparatus according to claim 6, wherein the information on the recording material is information on a width of the recording material with respect to the widthwise direction.

9. An image forming apparatus according to claim 6, wherein the voltage to be applied to the transfer member by the power source, at which the predetermined voltage is maintained by the constant-voltage element, is obtained from a relationship between the voltage to be applied to the transfer member by the power source and a current passing through the constant-voltage element.

10. An image forming apparatus according to claim 1, wherein the constant-voltage element is a Zener diode or a varistor.

11. An image forming apparatus according to claim 1, wherein the predetermined voltage is a breakdown voltage of the constant-voltage element.

12. An image forming apparatus according to claim 1, wherein the intermediary transfer member has a structure of two layers or more, and a volume resistivity of the layer in the outer peripheral surface side is higher than a volume resistivity of the layer in an inner peripheral surface side.

13. An image forming apparatus according to claim 1, wherein the intermediary transfer member is an intermediary transfer belt, and the image forming apparatus comprises a plurality of stretching members configured to stretch the intermediary transfer belt in contact with an inner peripheral surface of the intermediary transfer belt.

14. An image forming apparatus according to claim 13, wherein the constant-voltage element is connected between each of the stretching members and a ground potential.

* * * * *